United States Patent [19]

Dismukes

[11] Patent Number: 4,646,856

[45] Date of Patent: Mar. 3, 1987

[54] DOWNHOLE MOTOR ASSEMBLY

[76] Inventor: Newton B. Dismukes, 2952 Buttonwood Dr., Carrollton, Tex. 75006

[21] Appl. No.: 756,817

[22] Filed: Jul. 18, 1985

Related U.S. Application Data

[63] Continuation-in-part of Ser. No. 535,990, Sep. 26,.1983, Pat. No. 4,616,719.

[51] Int. Cl.[4] ..... E21B 4/02

[52] U.S. Cl. ..... 175/107; 175/320

[58] Field of Search ..... 175/320, 101, 92, 94–97, 175/104–107, 61, 62, 65

[56] References Cited

U.S. PATENT DOCUMENTS 2,944,792 7/1960 Gros ..... 175/107

3,598,187 8/1971 Mothre ..... 175/107 X

FOREIGN PATENT DOCUMENTS 1235834 3/1967 Fed. Rep. of Germany ..... 175/107

*Primary Examiner*—Stephen J. Novosad

*Assistant Examiner*—Thuy M. Bui

*Attorney, Agent, or Firm*—Drude Faulconer

[57] ABSTRACT

A rigid, stiffened downhole motor assembly for drilling a vertical wellbore of increased straightness wherein substantially more weight can be applied to the drill bit driven by the motor without subjecting the case of the motor to those compressive and/or bending forces previously experienced by known downhole motors in similar drilling operations. The present assembly comprises a housing of heavy-walled conduit which is coupled to the lower end of a tool string. A downhole motor, e.g. a "mud" motor is positioned within the housing and is operably coupled thereto by a means which allows the weight of the housing to be transferred to the drill bit without subjecting the motor case to compressive or bending forces. Also, an annulus is provided between the housing and the case of the motor so that a greater volume of drilling fluid can be flowed through the tool string to thereby provide better cooling of the bit and better removal of cuttings from the wellbore.

24 Claims, 6 Drawing Figures

DOWNHOLE MOTOR ASSEMBLY

CROSS-REFERENCES TO RELATED APPLICATIONS

Continuation-in-part of U.S. Ser. No. 535,990, filed Sept. 26, 1983, now U.S. Pat. No. 4,616,719.

DESCRIPTION

Technical Field

The present invention relates to a downhole motor assembly for drilling and/or casing wells and more particularly relates to a stiffened downhole motor assembly which is capable of drilling and/or casing straight, vertical boreholes as well as directional boreholes.

BACKGROUND OF THE INVENTION

The use of downhole motors in the drilling and completion of wells is well known in the art. However, until recently, due to certain shortcomings, such motors have been used almost exclusively for special situations (e.g. drilling of directional wells) and have found only limited use in the everyday drilling of straight, vertical wells. Some of these shortcomings have been overcome by recent developments in drill bits and in certain materials used in the construction of the motors, themselves.

Two types of fluid-powered downhole motors (mud motors) are in general use. Most popular in the United States is the Moineau, positive displacement type. The turbine motor is widely used in the Soviet Union, the North Sea and the Middle East. Electrically powered motors are not greatly used in drilling today because of difficulties in handling the power cable. The instant invention is applicable to all three types of downhole drilling motors.

However, problems still remain which have to be overcome before downhole motors will find widespread acceptance in routine straight-hole drilling operations. Probably the most pressing of these problems lies in the inability to apply sufficient weight-on-bit when using known downhole motors to achieve satisfactory straight-hole drilling and to optimize the drilling rate of penetration. This problem results from the fact that the outer case of the motor is coupled directly into and forms an integral portion of the drill string. The outer motor case does not have the stiffness required throughout its length and hence to bend when it transmits the necessary drill collar weight onto the bit to carry out the desired drilling operation. In other words, if sufficient drill collar weight is applied through the length of the motor case, the compressive and bending forces on the case become excessive and can cause severe damage to the motor or crooked holes. Also, since the motor case is coupled directly into the drill string, the connection between the motor and the drill bit is such that shock loads experienced during drilling are transmitted directly to the motor thereby causing undue wear on the bearings and seals thereof which, in turn, lead to early failure.

Further, existing downhole motors do not have the torque or horsepower required to rotate the drill bit when heavily weighted as is usually required for economic straight-hole drilling. It has been proposed to stack several power sections of a motor in tandem to increase the horsepower output of the motor but again the flexibility of the motor case severely restricts the number such sections that can be stacked in the drill string. Still further, the drilling fluid which passes through the motor to drive the rotor thereof creates a pressure drop across the motor which results in a downward pressure or thrust which normally is transmitted to the drill bit when the drill string is lowered onto the bottom of the wellbore. When this downward hydraulic thrust is exactly balanced by the weight-on-bit, there is no vertical load on the bearings in the motor. This no-load or "neutral" condition is ideal for long bearing life and, although recommended by most downhole motor suppliers, is extremely difficult to achieve and maintain during drilling operations. This commonly results in uneconomically slow rate of penetration or in excessive motor wear.

Present motor characteristics, also, generally limit both the rate of flow of drilling fluid through the motor and the pressure drop (mentioned above) which the motor can handle without damage. This limited rate of flow is usually less than that desired or required for the proper cooling of the bit or for proper cuttings removal in most straight-hole drilling operations.

DISCLOSURE OF THE INVENTION

The present invention provides a rigid, heavy-duty assembly which allows the drilling and/or casing of a wellbore of increased straightness when using a downhole motor. This present downhole assembly allows an increase in weight-on-bit availability which, in turn, improves rate of penetration and broadens drill bit selection. The present assembly also eliminates compressive and buckling forces on the downhole motor. These normally are caused by the application of drill collar weight onto the case of the motor. This new assembly simplifies motor construction, increases torque and horsepower availability which, in turn, permits more rapid drilling of large diameter boreholes. Shock loads on the downhole motor are reduced which lengthens motor life between overhauls. Also, by providing increased permissible drilling fluid circulation rates through the tool string which carries the downhole motor, the present assembly results in better cleaning of the bottom of the borehole, improved cooling of the bit, and better removal of cuttings from the borehole.

More specifically, the downhole assembly of the present invention is comprised of a tubular housing which is connected into the tool string (i.e. drill or casing string of pipe) near the lower end thereof. This housing preferably is comprised of heavy-walled pipe and is of sufficient dimensions to provide significant additional weight to the drill bit for a particular drilling operation. A downhole motor, e.g. a "mud motor", is mounted within the housing and is coupled thereto so that the weight of the housing and of the drill string above it are transmitted directly to the drill bit which is being driven by the motor.

In a first embodiment, a complete downhole motor is positioned within a housing which in turn is coupled to the lower end of a tool string. The case of the motor is connected to the housing through a supplementary bearing assembly so that the substantial weight of the housing is transferred to the drill bit without subjecting the case of the motor to buckling forces while, at the same time, allowing the motor to operate very close to the hydraulic neutral condition at all times. The relative diameters of the housing and motor case are such that an annulus is formed therebetween which allows a substantial portion of the drilling fluid being supplied through the tool string to bypass the motor and exit through ports at the lower end of the housing.

In another embodiment, the housing of the present invention forms an integral lower portion of the tool string. A hollow shaft which carries the drill bit is rotatably mounted by a thrust bearing assembly in the lower end of said housing whereby the weight of the housing is transmitted to the hollow shaft when the drill bit is on bottom. The upper end of the hollow shaft is splined to receive the drive shaft of a downhole motor which can be run into and out of the tool string from the surface. The motor is positioned on a resilient shock support within the housing which cushions drilling shock loads and which controls the relative movement between the motor and the housing thereby permitting the motor to operate in the desired neutral condition. Again, the relative diameters of the housing and the motor case are such that there is substantial flow of drilling fluid through the annulus which is formed between the two, said flow exiting through the hollow shaft below the motor.

In still another modification, the downhole motor is "cocked" in the housing at an angle relative to the longitudinal axis of the housing so that the downhole assembly can be used to drill a hole that will be deviated in any direction.

BRIEF DESCRIPTION OF THE DRAWINGS

The actual construction, operation, and manifest advantages of the present invention will be better understood by referring to the drawings in which like numerals identify like parts and in which.

BEST MODES FOR CARRYING OUT THE INVENTION

Figure 1:
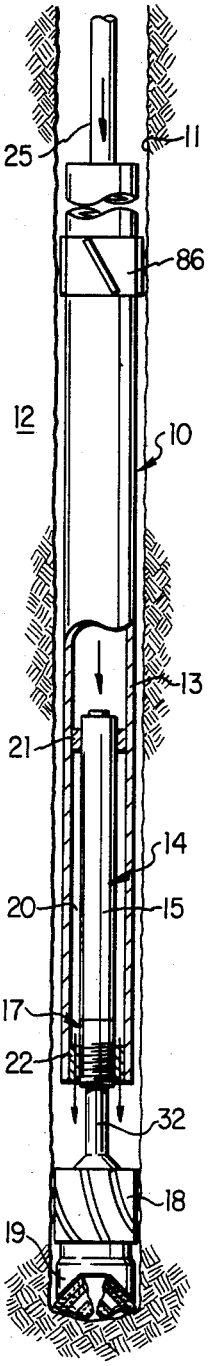
FIG. 1 is a cross-sectional view, partly in section, of the lower end of a tool string having the downhole motor assembly of the present invention incorporated therein.

Referring more particularly to the drawings, FIG. 1 discloses a downhole assembly 10 in accordance with the present invention as it is being used in the drilling of wellbore 11 through earthen formations 12. Downhole assembly 10 is comprised of tubular housing 13 which, in turn, comprises a desired length of tubular conduit members (e.g. heavy-walled casing, drill collars, or the like). Housing 13 is coupled to the lower end of tool string 25 (e.g. standard drill pipe) which extends to the earth's surface (not shown).

Mounted within housing 13 is a conventional downhole motor 14 including its usual bearing system. Motor 14 may be of any of several well known commercially available downhole motors As shown, motor 14 is a "mud" driven, hydraulic motor and may be of the well-known positive displacement type (Moineau) motor such as those distributed by Dyna-Drill Division of Smith International, Irvine, Calif., or it may be of the well known turbine type such as those distributed by Neyrfor Turbodrilling Co., Burlingame, Calif.

Figure 2:
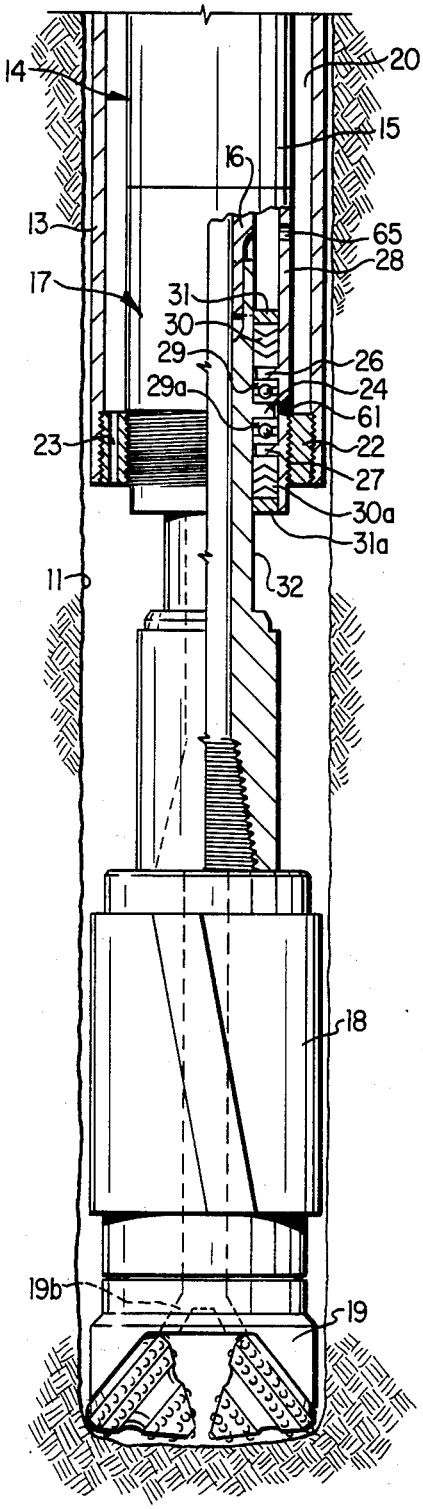
FIG. 2 is an enlarged view of the lower portion of FIG. 1.

Referring now to FIGS. 1 and 2, motor 14 is comprised of case 15 having a supplementary bearing assembly 17 connected to and forming an integral portion thereof. Output shaft 16 (FIG. 2) of motor 14 is coupled (e.g. via a splined connection) to hollow drive shaft 32 which is journalled in supplemental bearing assembly 17 and which carries a stabilizer or reamer 18 and drill bit 19 at its lower end. As is well known in the art, power output shaft 16 is driven by a rotor section 45 (FIG. 3) in motor 14 which, in turn, is powered by the flow of drilling fluid therethrough. The outer diameter of case 15 is substantially smaller than the inside diameter of housing 13 so that when assembled, an annulus 20 is formed between the two. In the embodiment of FIGS. 1 and 2, case 15 of motor 14 encloses a conventional assembly while supplemental bearing assembly 17 is fixed directly to housing 13 by a plurality of bushings or the like spaced along the length of case 15 (only upper and lower bushings 21, 22, respectively, are shown in FIG. 1). These bushings all have one or more openings or ports 23 (FIG. 2) therethrough to allow fluid flow through annulus 20 as will be explained more fully below.

It is well known in this art that the passage of drilling fluid through a downhole "mud" motor acts to create a pressure drop across the rotor section which exerts a substantial downward force thereon. This force is one of the principle reasons for wear in such motors. The vertical loads on the conventional thrust bearings (not shown) of the motor resulting from this downward force are high and the operating conditions are harsh. Wear results in the relative vertical movement between the rotor and the stator which, in turn, cause interference, abrasion, and erosion between the two. To compensate for this movement, suppliers of most commercially available downhole motors recommend that the formation resistance to the bit (i.e. weight-on-bit) or upthrust be closely matched to the downthrust created by the hydraulic pressure drop across the motor so that the upward and downward forces on the motor's bearing are balanced and the motor can operate in a substantially neutral condition.

Supplemental bearing assembly 17 of the present invention is designed to eliminate a substantial portion of the wear normally associated with mud motors of this type. Drive shaft 32 (FIG. 2) has an annular flange 24 thereon which is positioned between annular flanges 26, 27 on case 28 of bearing assembly 17. Thrust bearing 29, **29*a* are positioned between flange 24 and glanges 26, 27, respectively, and are sealed against contact with the drilling fluid by sealing means, e.g. chevron packing 30, 30*a* or the like, which are held in place by plates 31, 31*a*. These plates can be threaded upwardly or downwardly within case 28 to compress packing 30, 30*a* as desired. Bearings 29, 29*a* are packed with a lubricant, sealant, or the like through threaded plugged opening 61. Ports 65 are provided in case 28 to equalize the fluid pressure across seals 30, 30*a* and bearings 29, 29*a***.

It can be seen that bearing assembly 17 can allow motor 14 to operate in a substantially neutral condition even when the downward hydraulic thrust and the upthrust due to weight-on-bit are not in balance. That is, any substantially downward movement of drive shaft 32, and hence output shaft 16 of motor 14, which would normally occur upon the application of fluid flow through motor 14 is prevented by flange 24, bearing 29a, and flange 27. Likewise, any substantial upward movement normally caused by excessive weight-on-bit is prevented by flange 24, bearing 29, and flange 26. By preventing these movements of shaft 16, the thrust bearings (not shown) in motor 14, itself, are isolated and are not subject to excessive wear as heretofore.

Due to the present construction, if bearings 29, 29a experience excessive wear, they can easily be replaced by merely replacing bearing assembly 17 with a new assembly, or in the event of slight wear, shims (not shown) or the like can be placed on the respective flanges in bearing assembly 17 when tool string 25 is withdrawn. In some instances, some space or play is provided between flanges 24, 26 and bearing 29 to facilitate the starting of motor 14.

In operation, case 28 of bearing assembly 17 is coupled to case 15 of motor 14 and forms an integral part thereof, and shafts 16, 32 are coupled together. Motor 14 is then secured in housing 13 by bushings 21, 22 and housing 13 is coupled to the lower end of tool string 25 is lowered therewith. The weight of housing 13 is transferred to the lower end of motor case 15 (i.e. case 28 of bearing assembly 17) through bushing 22 and then to drive shaft 32 via flange 26, bearing 29, and flange 24. This weight transfer is accomplished without applying any bending or compressive loading on motor case 15. This allows a substantially greater weight to be applied on the bit than was previously possible with downhole motors of this type. Further, since the motor case does not carry any significant compressive load, motor 14 may be of any convenient length. This permits more than one power stage (rotor section) to be stacked in series or tandem (not shown) thereby increasing the torque output of the motor 14. In brief, motor flexibility or bending no longer is a problem.

Further, since annulus 20 and ports 23 in bushing 21, 22 provide a fluid passage around motor 14, a substantially greater amount of drilling fluid can be flowed through the tool string 25 and is not limited by the characteristics of motor 14 (e.g. pressure drop across the motor, etc.). This flow through annulus 20 when added to the normal flow of drilling fluid through motor 14, hollow shaft 16, and watercourses 19b in bit 19 greatly increases the cooling and cleaning actions around bit 19 during drilling operations.

The following sets forth a more detailed example of a typical downhole assembly 10 as illustrated in FIGS. 1 and 2. A housing 13 of downhole assembly 10 having a length of 600 feet (e.g. 300 feet of heavy-walled, 16-inch diameter well casing and 300 feet of large diameter drill collars) is coupled onto the lower end of a string 25 of standard, 4½ or 5-inch diameter drill pipe. A 60 foot long, 9½-inch diameter turbodrill (or positive displacement mud motor), e.g. a turbodrill motor such as distributed by Neyrfor Turbodrilling Co. of Burlingame, Calif. having a 600 gallon per minute capacity and capable of developing 500–600 horsepower is mounted in housing 13 by bushings 21, 22. An 18½-inch diameter drill bit 19 (e.g. diamond or Stratapax bit) and a 18-7/16-inch diameter reamer 18 is mounted on output shaft 16 of motor 14. One or more 18-7/16 inch stabilizers of key seat wipers 86 (only one shown) are mounted at spaced points along housing 13 to aid in drilling a straight and clean wellbore 11. As explained above, weight from housing 13 is transferred to bit 19 upon the lowering of drill string 25 without subjecting motor case 14 to any compressive or bending forces and sufficient drilling fluid is supplied to the bottom of wellbore 11 to insure proper cooling of bit 19 and to provide adequate removal of cuttings.

Figure 3:
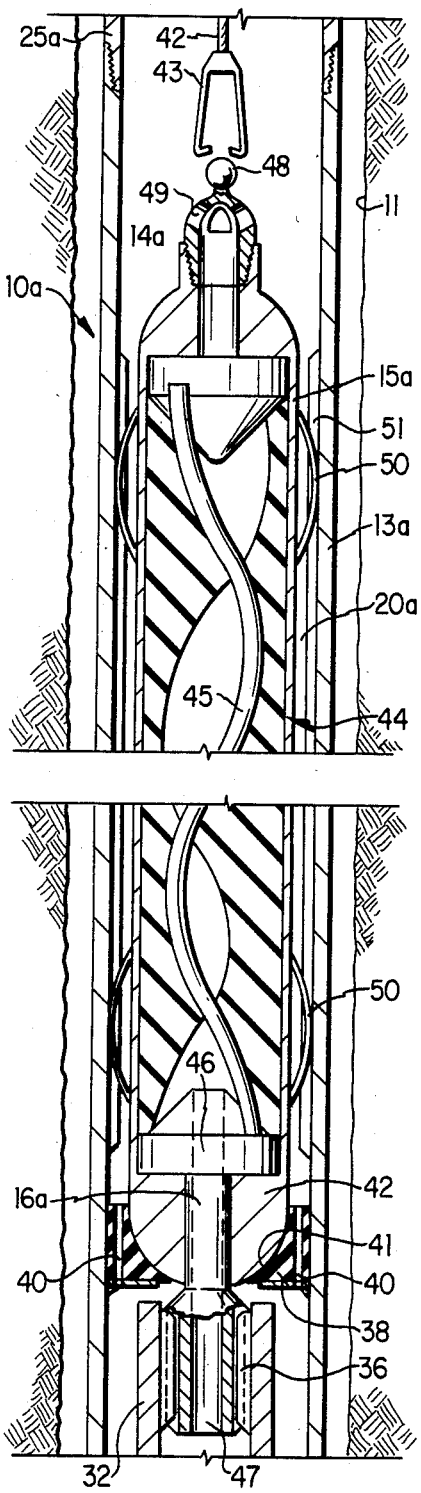
FIG. 3 is a cross-sectional view of the upper portion of a further embodiment of the present invention.
Figure 4:
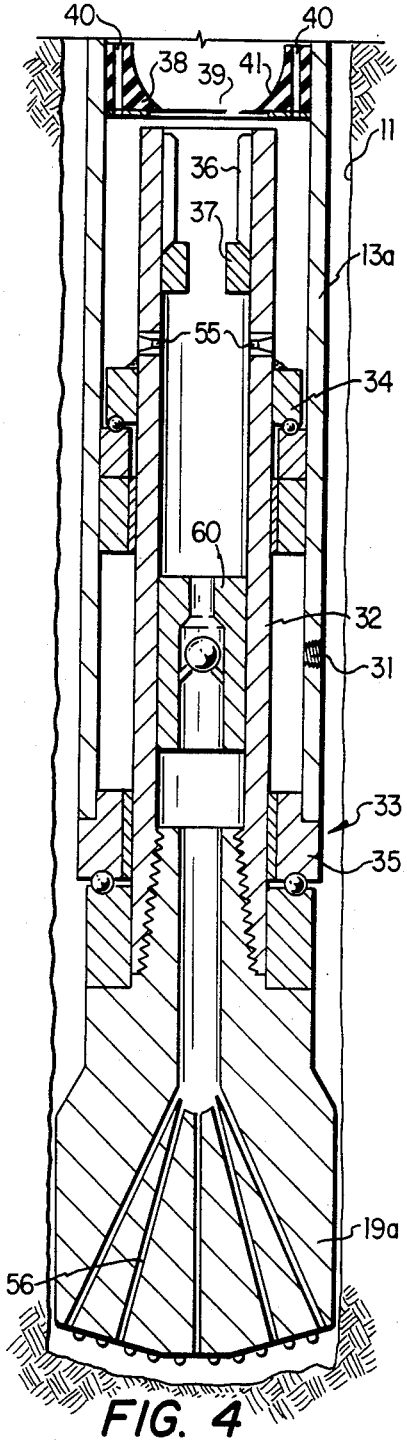
FIG. 4 is a cross-sectional view of the lower portion of the embodiment of FIG. 3.

Another embodiment of the present invention is disclosed in FIGS. 3 and 4 and constitutes an improvement over a similar downhole motor assembly disclosed in the present applicant's co-pending U.S. patent application Ser. No. 535,990, filed Sept. 26, 1983. In this embodiment, a downhole motor is retrievable through the tool string and is removably mounted in the housing in such a way that the motor is capable of operating in a substantially neutral condition and is effectively isolated from any shocks experienced by the bit.

Referring more particularly to FIGS. 3 and 4, downhole motor assembly 10a is comprised of housing 13a which, in turn, is comprised of a desired length of heavy-walled casing. Housing 13a is coupled into and forms an integral portion of tool string 25a (e.g. steel pipe of sufficient inside diameter to pass motor case 15a). Hollow drive shaft 32 is journalled in the lower end of housing 13a by thrust bearing assembly 33, which, in turn is comprised of upper and lower thrust bearing 34, 35, with the space therebetween being filled with lubricant or the like through opening 31. Shaft 32 has a female, splined connection 36 at its upper end and carries drill bit 19a at its lower end. Fixed inside shaft 32, immediately below female spline 36, is stop 37 which limits the distance which male spline 37 can penetrate into shaft 32. Its purpose is described later.

Fixed securely within housing 13a at a point above the upper end of shaft 32, is a resilient, shock-absorbing support 38 which may be comprised of any suitable resilient or elastomeric material, which is resistive to the effects of oil or drilling fluid (e.g. Buna rubber). Support 38 is provided with a central opening 39 therethrough which defines a seat 41 and one or more ports or openings 40 therethrough. Motor 14a is shown in its operable position and is supported on seat 41 of support 38. Although motor 14a is illustrated as a positive-displacement (Moineau) motor such as those distributed by Dyna-Drill Division of Smith International, Inc., it should be understood that it may also be turbine-type motor or an electric motor without departing from the present invention.

As illustrated, motor 14a is comprised of an outer case 15a having a Moineau stator section 44 and a rotor 45 therein. As understood in the art, fluid flowing through motor 14a will drive rotor 45 which, in turn, drives output shaft 16a through connecting rod section 46; these rotating elements of motor 14a being mounted in case 15a by thrust bearings (not shown) or the like. Output shaft 16a of a typical downhole motor such as that described would normally carry the drill bit but in the present invention has a male, splined connection 47 thereon which is adapted to be received by the female, splined connection 36 of drive shaft 32 when motor 14a is in an operable position on support 38.

Mounted on the upper end of case 15a of motor 14a is a "fishing" head 48 which is adapted to be engaged by a wireline overshot tool 43 or the like to thereby lower and/or raise motor 14a through tool string 25a and into and/or out of housing 13a as will be explained in more detail below. Head 48 has openings 49 therethrough to permit normal fluid flow through motor 14a. Spring centralizers 50 or the equivalent are spaced on case 15a and are adapted to cooperate with spline 51 in housing 13a to allow longitudinal movement but to prevent relative rotational movement between casing 15a and housing 13a when motor 14a is in an operable position within housing 13a. An annulus 20a is formed between case 15a and housing 13a when motor 14a is in position on support 38.

In operation, housing 13a is coupled into and forms an integral part of tool string 25a. Motor 14a may be directly placed in position onto seat 41 of support 38 and lowered with the tool string 25 or if tool string 25 is first run into place, then motor 14a is lowered from the surface by a wireline 42 or the like. As motor 14a is lowered, centralizers 50 on case 15a engage splines 51 in housing 13a thereby preventing relative rotational movement therebetween. Male spline connector 47 on output shaft 16a engages female spline connector 36 on drive shaft 32 to form a slidable driving connection therebetween.

Drilling fluid is then flowed under pressure down through drill string 25a and through motor 14a. As drilling fluid begins to flow through motor 14a, resilient support 38 is compressed due to the pressure drop through the motor and the pressure differential across the motor. This latter force is controlled by the size of openings 40 through support 38. The compressibility of support 38 is designed to allow just enough downward movement of motor 14a relative to stop 37 to balance the downward force on rotor 45 which is also caused by the pressure drop through the motor. Upward resisting force from earth formation 12 on bit 19a is transmitted directly to the lower end of housing 13a via lower bearing 35, as shown in FIG. 4. Thus, motor 14a in the present invention operates in or very near the desired "neutral" condition as recommended by most motor suppliers.

Fluid passing through ports 40 in support 38 will flow into hollow drive shaft 32 through ports 55 (FIG. 4) therein and will flow along with the drilling fluid exhausted from motor 14a out through watercourses 56 in bit 19a. This excess fluid flowing through the bit insures proper cooling of the bit and aids in the removal of cuttings from wellbore 11. Also, the slidable connection between shafts 16a, 32 and the resiliency of support 38 serves to protect motor 14a from vibration and shock loads that are encountered by bit 19a during drilling.

Since motor case 15a and housing 13a are coupled to prevent rotational movement therebetween, operation of motor 14a creates a counter-torque on the entire tool string 25a. Due to the faster hole drilled by the greater weight-on-bit capability of the present downhole motor assembly, this counter or reverse torque may be sufficient to counter rotate the tool string. The counter-rotation, which can be controlled by a simple brake at the surface, is beneficial in most instances since it lessens the threat of differential sticking of the tool string. Also, this counter-rotation may effectively reduce the rotary speed of the drill bit which also is beneficial in some instances since a number of commercially-available bits perform better at speeds below the optimum rotational speed of some downhole motors.

In some instances, it may be desirable to use downhole assembly 10a to place casing in a wellbore and cement that casing in place to complete a well or an interval thereof. For such an application, a float valve 60 (FIG. 4) is secured within hollow drive shaft 32. As understood, valve 60 allows downward flow through shaft 32 but prevents back flow therethrough. In operation, wellbore 11 would be drilled with motor 14a and bit 19a as described above. When the desired depth of wellbore 11 is reached, an overshot tool 43 is lowered on a wireline 42 to engage fishing head 48 on motor 14a. Motor 14a then is raised to the surface and tool string 25 and housing 13a which together comprise the casing, are cemented in place by flowing cement down string 25, through valve 60, and out through watercourses 56 in bit 19a into the annulus between tool string 25a and wellbore 11.

Figure 5:
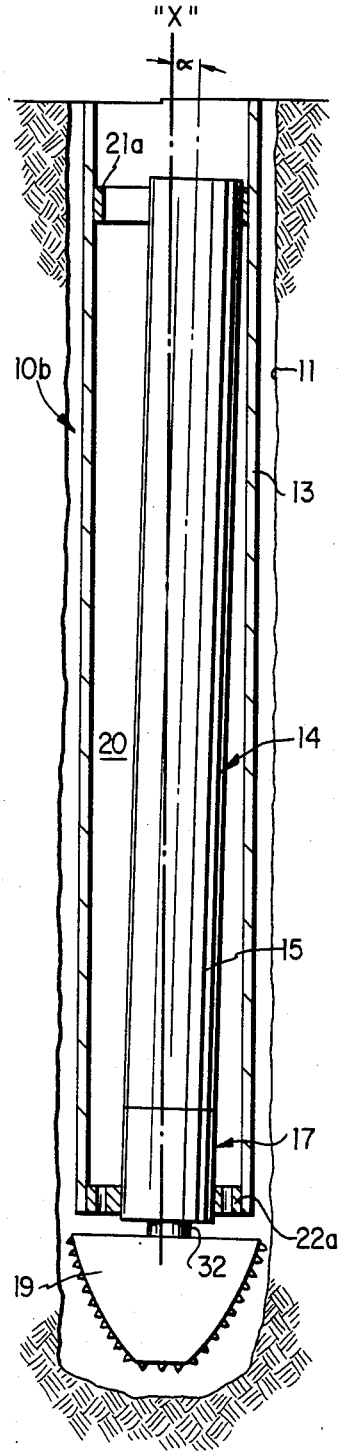
FIG. 5 is still another embodiment of the present invention wherein the downhole motor is positioned at an angle with respect to the housing of the assembly.

In still another embodiment of the present invention, FIG. 5 illustrates a downhole motor assembly 10b which is used for drilling a wellbore which is to be deviated. Housing 13 is constructed basically identical to that shown and described above in relation to the embodiment of FIGS. 1 and 2 and is coupled onto the lower end of a tool string (not shown). Motor 14, bearing assembly 17, drive shaft 32, and bit 19 are identical to those described above but are positioned or "cocked" within housing 13 at an angle "$\alpha$" (e.g. 0.1–2 degrees) with respect to the longitudinal axis 'X' of housing 13 and secured thereto by bushings 21a, 22a. Fluid passages 23a are provided through bushing 21a, 22a to permit flow of fluid through annulus 20 around motor 14. The operation of this embodiment is same as above except that the direction of a wellbore may be changed by causing housing 13 to turn up to 180 degrees in either a clockwise or counterclockwise direction.

Figure 6:
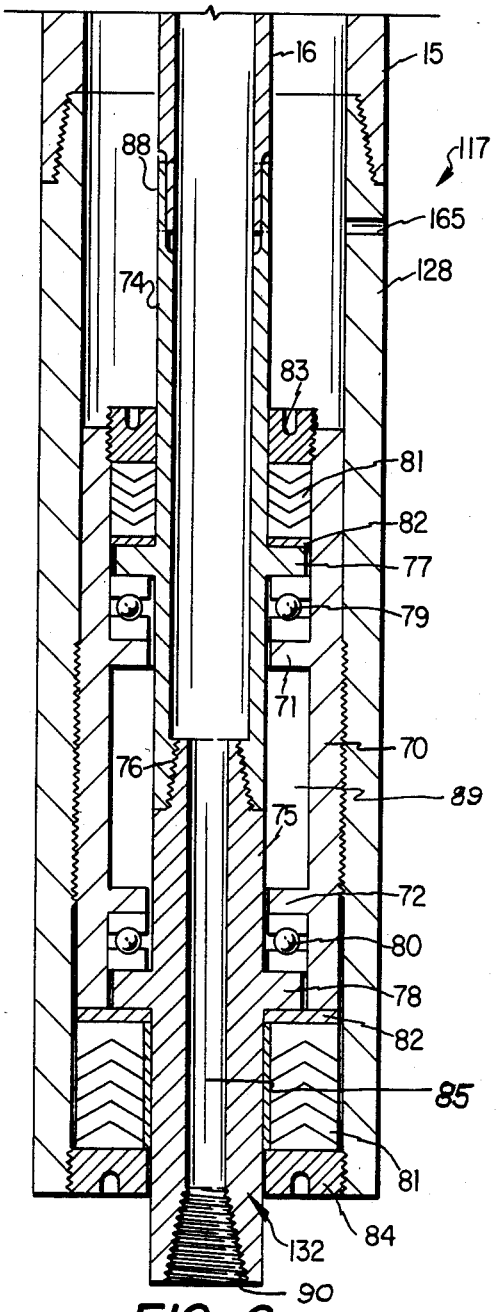
FIG. 6 shows details of the bearing assembly in cross section.

FIG. 6 discloses a further embodiment of a supplementary bearing assembly 117 which can be used with motor 14 of FIG. 1. Supplementary bearing assembly 117 comprises a bearing case 128 which is threaded or otherwise affixed to the lower end of motor case 15. Cylindrical bearing support 70 is threaded or otherwise secured in the bore of bearing case 128 and has upper and lower annular flanges 71, 72, respectfully, spaced within the bore thereof. Hollow drive shaft 132 is comprised of upper section 74 having an outer annular flange 77 thereon and a lower section 75 having an outer annular flange 78 thereon and are threaded together at 76 for ease of construction. Upper bearing 79 is positioned between upper flange 71 on support 128 and flange 77 on shaft section 74 and lower bearing 80 is positioned between lower flange 72 on support 128 and flange 78 on shaft section 75. Chevron packing 81 or equivalent and packing supports 82 are positioned above flange 77 and below flange 78, respectfully, and are held in place by threaded upper and lower bushings 83, 84, respectively. Packing 81, which is compressed by bushings 83, 84, protect bearings 79, 80 from contact with the drilling fluids. Radial marine bearing 85 centers shaft 132 in the bearing support 70 and absorbs lateral thrust which might develop during drilling operations.

Shaft section 74 is splined at its upper end 88 to receive the lower end of output shaft 16 of motor 14 to form a slidable, driving connection, which allows relative longitudinal movement therebetween. The space 89 between flanges 71 and 72 in support 70 forms a reservoir which is filled with a bearing lubricant at the time of assembly. Shaft section 75 is threaded at its lower end 90 to receive a drill bit 19 and/or stabilizer 18 as shown in FIG. 1. Ports 165 in case 128 equalizes fluid pressure across the packing and bearings.

What is claimed is:

1. A downhole assembly comprising:

a housing adapted to be connected to the lower end of a tool string which is to be used to drill a wellbore;

a downhole rotary motor having an outer motor case for encasing all of the internal components of said motor, said motor positioned within said housing and having an output shaft;

a drill bit below said housing;

means for connecting said drill bit to said output shaft of said motor; and means for transferring the weight of said housing and said tool string to said drill bit as the tool string is lowered when said drill bit is on the bottom of the wellbore without applying compressive or bending forces on said outer motor case of said motor.

2. The downhole assembly of claim 1 wherein said housing is comprised of a length of heavy-walled tubular conduit.

3. The downhole assembly of claim 2 wherein said downhole motor is a hydraulic motor powered by fluid supplied through said tool string.

4. The downhole assembly of claim 3 wherein said weight transfer means comprises:

means for connecting the lower end of said outer motor case of said motor to the lower end of said housing.

5. The downhole assembly of claim 4 wherein said means for connecting the lower end of said outer motor case to said lower end of said housing comprises a bushing.

6. The downhole assembly of claim 1 wherein the outside diameter of said outer motor case is less than the inside diameter of said housing so that an annulus is formed between said outer motor case and said housing to permit fluid flow therethrough and wherein said means for transferring the weight has fluid ports therethrough.

7. The downhole assembly of claim 6 including:

a bearing case connected to the lower end of said outer motor case;

a drive shaft in said bearing case having one end connected to said output shaft of said motor and the other end thereof connected to said drill bit; and bearing means in said bearing case for rotatably securing said drive shaft in said bearing case.

8. The downhole assembly of claim 7 wherein said bearing means comprises:

an upper and lower flange extending inwardly from the inner surface of said bearing case and spaced from each other;

a flange extending outward from said drive shaft and being positioned between said upper and lower flanges on said bearing case;

a first bearing positioned between said drive shaft flange and said upper flange; and a second bearing positioned between said drive shaft flange and said lower flange.

9. The downhole assembly of claim 7 wherein said bearing means comprises:

an upper flange and a lower flange extending inwardly from said bearing case and spaced from each other;

an upper flange extending outward from said drive shaft and being positioned above said upper bearing case flange and a lower flange extending outward from said drive shaft and being positioned below said lower bearing case flange;

an upper bearing positioned between said upper flanges; and a lower bearing positioned between said lower flanges.

10. The downhole assembly of claim 1 including:

means to position said motor within said housing at an angle with respect to the longitudinal axis of said housing.

11. The donwhole assembly of claim 3 including a splined connection on said output shaft of said motor; and wherein said weight transfer means comprises:

a drive shaft positioned within said housing, said drive shaft having a splined connection at one end thereof which cooperates with said splined connection on said output shaft to form a slidable, driving connection therebetween;

means for connecting said drill bit to the other end of said drive shaft; and bearing means for rotatably securing said drive shaft to said housing.

12. The downhole assembly of claim 1 including:

a support comprised of a resilient material mounted in said housing on which said downhole motor is positioned.

13. A downhole drilling assembly comprising:

a housing adapted to be connected onto the lower end of a tool string which is to be used to drill a well bore;

a drive shaft positioned within said housing and extending out of the lower end thereof; said drive shaft having a splined connection on its upper end thereof;

a drill bit connected to the lower end of said drive shaft;

bearing means rotatably securing said drive shaft into said housing through which the weight of said housing is transferred to said drive shaft and said drill bit upon lowering of said tool string when said drill bit is on the bottom of said wellbore;

a support comprised of a resilient material secured within said housing;

a downhole motor having an outer motor case for encasing all of the internal components of said motor, said motor having an output shaft having a splined connection thereon, said motor positioned on and supported by said resilient support so that said splined connection on said output shaft cooperates with said splined connection on said drive shaft to form a slidably, driving connection therebetween.

14. The downhole assembly of claim 13 wherein said housing is comprised of a length of heavy-walled tubular conduit.

15. The downhole assembly of claim 14 wherein said downhole motor is a hydraulic motor powered by fluid supplied through the tool string.

16. The downhole assembly of claim 15 wherein the outside diameter of said outer motor case is less than the inside diameters of said housing so than an annulus is formed between said outer motor case and said housing, and a flow passage through said support to permit flow of fluid through said annulus around said outer motor case and through said support.

17. The downhole assembly of claim 16 wherein said drive shaft is hollow, and a fluid passage in said hollow drive shaft to permit flow between said housing and the interior of said hollow drive shaft.

18. The downhole assembly of claim 17 wherein said motor is positionable and retrievable through the tool string.

19. The downhole assembly of claim 18 including:

valve means positioned within said hollow shaft permitting downward flow therethrough but preventing upward flow therethrough.

20. The downhole assembly of claim 13 including:

means for removing said downhole motor from said housing through said tool string.

21. A downhole end assembly for a string of pipe of the type used in the drilling and/or completing a well bore in the earth, said end assembly comprising:

a housing having means thereon adapted for connecting said housing to one end of the string of pipe;

shaft means having a first end and a second end;

means for rotatably mounting said shaft means in said housing and for fixing said shaft means against axial movement through said housing;

connector means on said first end of said shaft means adapted for releasably connecting said shaft means to a downhole rotary prime mover.

22. The downhole assembly of claim 21 wherein said shaft means comprises:

a shaft having a fluid passageway through the axial length thereof;

and wherein said means for rotatably mounting and affixing said shaft to said housing comprises:

bearing means in said housing for allowing relative rotation between said shaft and said housing.

23. The downhole assembly of claim 22 including:

a well tool affixed to said second end of said shaft.

24. The downhole assembly of claim 23 wherein said well tool comprises a drill bit.

* * * * *